United States Patent [19]

Wenger et al.

[11] 4,152,374

[45] May 1, 1979

[54] DEVICE FOR INJECTING WATER VAPOR INTO COMBUSTION AIR

[76] Inventors: Lyman P. Wenger, 6364 Grand River Dr., Ada, Mich. 49301; Richard E. Cole, 2501 Longmeadow NW., Grand Rapids, Mich. 49504

[21] Appl. No.: 789,982

[22] Filed: Apr. 22, 1977

[51] Int. Cl.[2] ..... F02M 75/02

[52] U.S. Cl. ..... 261/24; 261/64 R; 261/124; 431/4; 431/354

[58] Field of Search ..... 261/18 A, 124; 431/4, 431/354

[56] References Cited

U.S. PATENT DOCUMENTS

| | | | |
|---|---|---|---|
| 2,384,609 | 9/1945 | De Vries | 261/124 |
| 3,606,985 | 9/1971 | Reed | 261/124 |
| 3,693,322 | 9/1972 | Lineberry et al. | 261/124 |
| 3,862,819 | 1/1975 | Wentworth | 431/4 |
| 4,009,984 | 3/1977 | Morrison | 431/4 |
| 4,014,637 | 3/1977 | Schena | 431/4 |

*Primary Examiner*—Carroll B. Dority, Jr.
*Attorney, Agent, or Firm*—Glenn B. Morse

[57] ABSTRACT

A container of water is subject to reduced air pressure to induce an inflow of air through conduits extending from the exterior of the container to a point below the level of the water in the container. Air entering through these conduits bubbles up through the water. The size of the bubbles is controlled by the ports at which the air moving in the conduits enters the water. The blower providing the reduced pressure delivers the moisture-ladened air from the bubbles to the intake of another blower providing combustion air for a burner installation. The minute quantities of vapor-ladened air are mixed in that blower, or in the blower intake chamber, with the remainder of the incoming combustion air. The supply of vapor is related to the firing rate in the burner by associating the burner control with the off-on condition of a valve in at least one of a plurality of air conduits of the container.

1 Claim, 5 Drawing Figures

FIG. 5
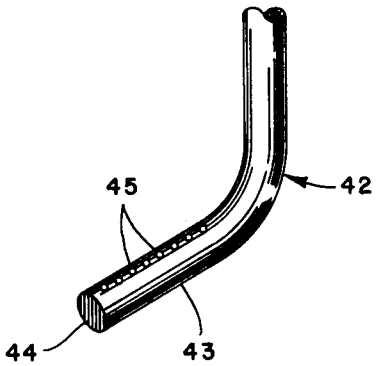
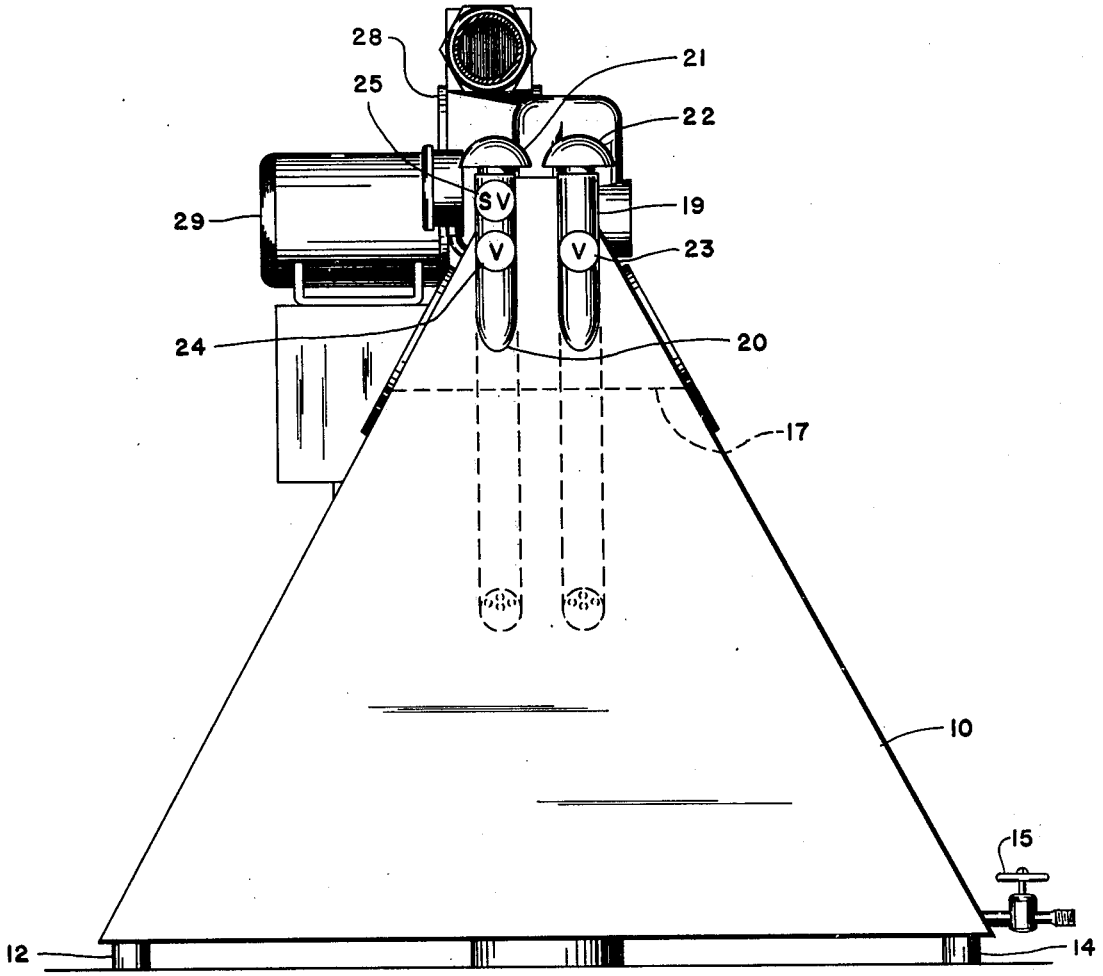
FIG. 2

DEVICE FOR INJECTING WATER VAPOR INTO COMBUSTION AIR

BACKGROUND OF THE INVENTION

The combustion of hydrocarbon fuels involves the chemical combination of oxygen with the carbon and with the hydrogen, producing water vapor and oxides of carbon. The nitrogen content of the air will frequently enter into the reaction to form various oxides of nitrogen as pollutants. Incomplete combustion can be expected to produce percentages of carbon monoxide, rather than exclusively carbon dioxide, primarily as a result of the impossibility of assuring a perfect mixture of the fuel and air, and the optimum combustion temperature. The classic assumption has always been that the oxygen would have a preference for the hydrogen in cases of incomplete combustion, and this would result in certain percentages of carbon monoxide in the exhaust gases, even where the theoretically quantity of air for proper combustion was present. This gas is not only an undesirable pollutant, but represents a loss of a considerable quantity of the available heat in the fuel.

It has been recognized for at least 50 years that the presence of moisture in the combustion space will significantly modify the combustion process. the injection of water spray into the cylinders of high-output air craft engines has been used as a means of supressing detonation, by the absorption of the heat of vaporization, which would otherwise peak to a point at which the fuel charge would detonate, rather than burn at a uniform rate. Another phenomenon, which has been less well recognized, has been the effects of minute quantities of water vapor in the combustion air. It has been known that the performance of internal combustion engines was frequently improved under conditions of increased humidity. It has also been observed that it was much more difficult to ignite a hydrocarbon fuel-air mixture at all under conditions of extremely low humidity. It was suspected that the water vapor was somehow entering into the combustion process and modifying it, but the nature of this interaction has not been general knowledge. It has, however, been known to specialists in this field for many years. One would normally expect that any dissociation of water vapor into its component oxygen and hydrogen would simply be a passive reaction, as it should re-combine to restore the energy of dissociation. The actual reaction involved, however, is far different. At a particular temperature level related to selected conditions of pressure, the dissociation of the water vapor into oxygen and hydrogen leaves these components in the nascent state, which places them in this condition in the company of the oxygen and hydrogen of the fuel in essentially the same state. Under these conditions, the usual valence laws establishing a preference of the carbon for hydrogen are reversed, with the oxygen then exhibiting a preference for the carbon. The carbon is then completely burned, and the remaining hydrogen is subsequently burned very easily after the oxidation of the carbon, whenever sufficient oxygen is present. This rather surprising behavior has also been observed for many years in a totally different setting. Firemen are very much aware that a coal pile burning from spontaneous combustion cannot be quenched by turning a hose on it. Such a procedure simply results in the migration of enough water vapor into the interior to enter into the dissociation phenomenon, resulting in very efficient burning of all the carbon, and then the subsequent burning of the hydrogen nearer the surface of the coal pile.

The dissociation phenomenon has been incorporated in internal combustion engines and in various forms of heatgenerating devices, frequently without a specific understanding of what was happening. The intake manifold of internal combustion engines provided with carburetors has frequently been supplied with vapor injectors of one form or another, as shown in the U.S. Pat. Nos. 3,724,429; 3,790,139; and 3,107,657. The Wentworth, Jr. U.S. Pat. No. 3,862,819 shows an example of the application of this principle to boilers and furnaces. In this patent, the disclosed system involves a bypass of the air of the primary combustion blower such that a reduced pressure in a container of water induces an inflow of air through a conduit extending to a point below water level. The resulting moisture-ladened air bubbling up through the liquid is removed by the blower, and is intermixed with the main stream of the intake air. Arrangements have also been proposed and used involving a continuous recirculation of the major portion of the air bubbling up through the liquid, which may conceivably increase the vapor content of the resulting air. The recirculation, however, complicates the problem of controlling the amount of vapor actually delivered to the combustion chamber. The quantities of water vapor that are administered to the combustion system in this manner must necessarily be very minute. Excessive moistur will tend to supress the combustion temperature, and interfere with the combustion process rather than improve it. It appears that the amount of water vapor should be closely related to the combustion conditions in a particular installation, so that the degree of incompleteness of combustion in the absence of water vapor can be compensated for by appropriate adjustment of the vapor-injection equipment.

SUMMARY OF THE INVENTION

The preferred form of the device incorporates a plurality of air-inlet conduits extending from the exterior of a water container to a position below the surface of the water in the container. The intake of a substantially constant-speed blower is associated with the space above the water level within the container to provide a reduced air pressure sufficient to induce inflow of air through the inlet conduits. At the point where the air emerges from the submerged ends of the conduits, the conduits terminate in inclined perforated plates for generating small bubbles of air. The output of the blower is conducted to a position adjacent the air intake of a blower associated with a combustion system, where small quantities of the air are permitted to intermix with the combustion air. In response to the operation of the combustion system at high levels of intensity, a valve in at least one of the air conduits of the container is opened so that it functions only under such combustion conditions. The vapor content of the air delivered by the system associated with the water container is maximized by causing the incoming air to enter the water through a plurality of small openings each less than three-eights of an inch in diameter, thus producing air masses that have a relatively large exposure to water surface. Certain of these holes are vertically spaced to provide a sequence in their functioning.

DESCRIPTION OF THE DRAWINGS

FIG. 2 is an end elevation of the unit shown in FIG. 1.

FIG. 5 is a perspective view of a modified section of the air-inlet conduit.

DESCRIPTION OF THE PREFERRED EMBODIMENTS

Figure 1:
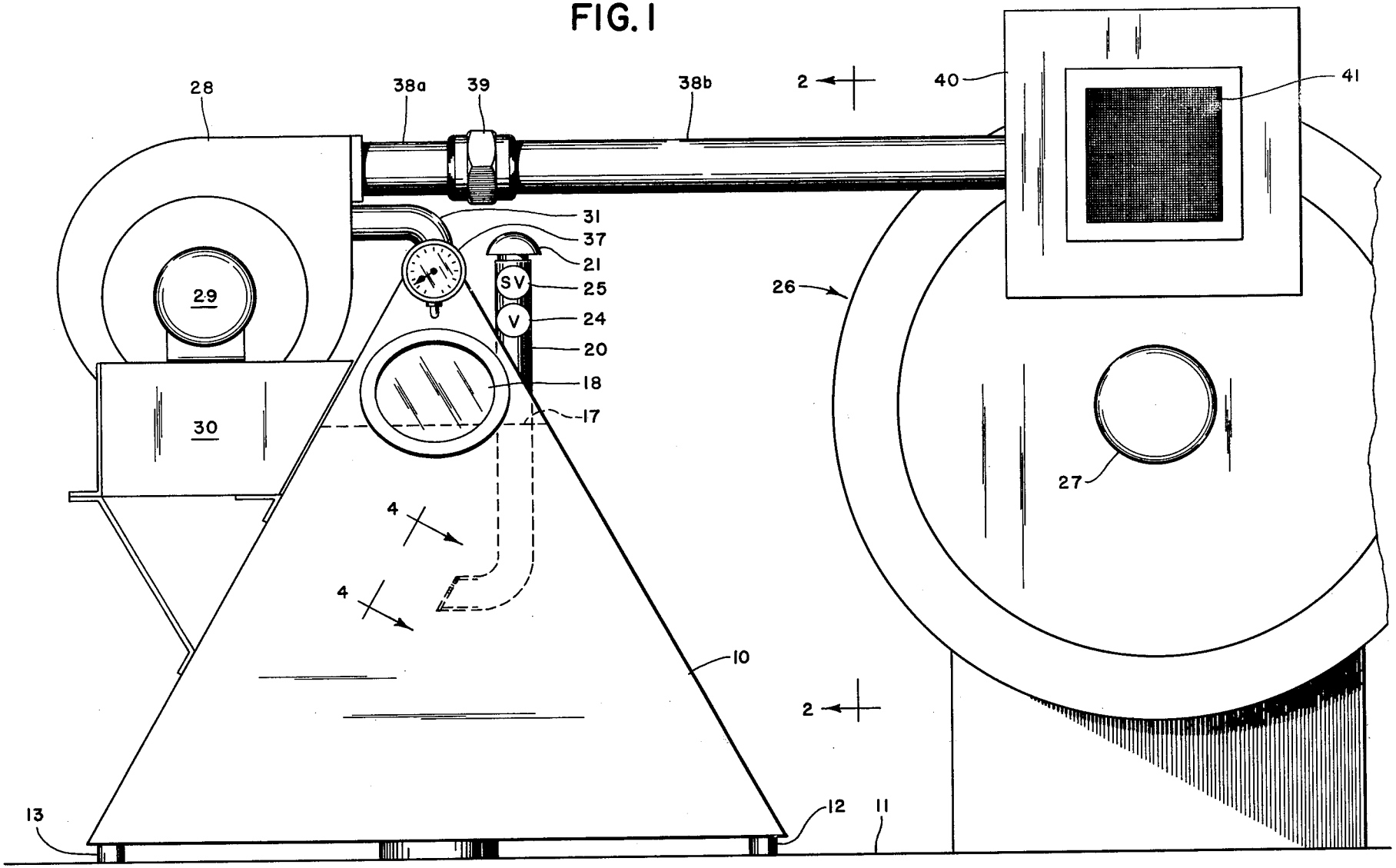
FIG. 1 is a side elevation showing a system for delivering small quantities of air charged with water vapor to a boiler installation.
Figure 4:
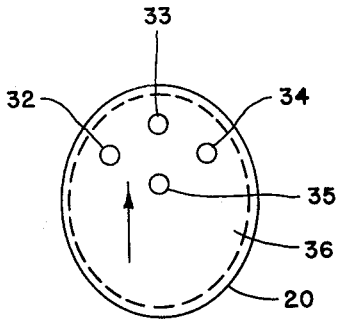
FIG. 4 is a view on an enlarged scale of the area indicated at 4—4 in FIG. 1.
Figure 3:
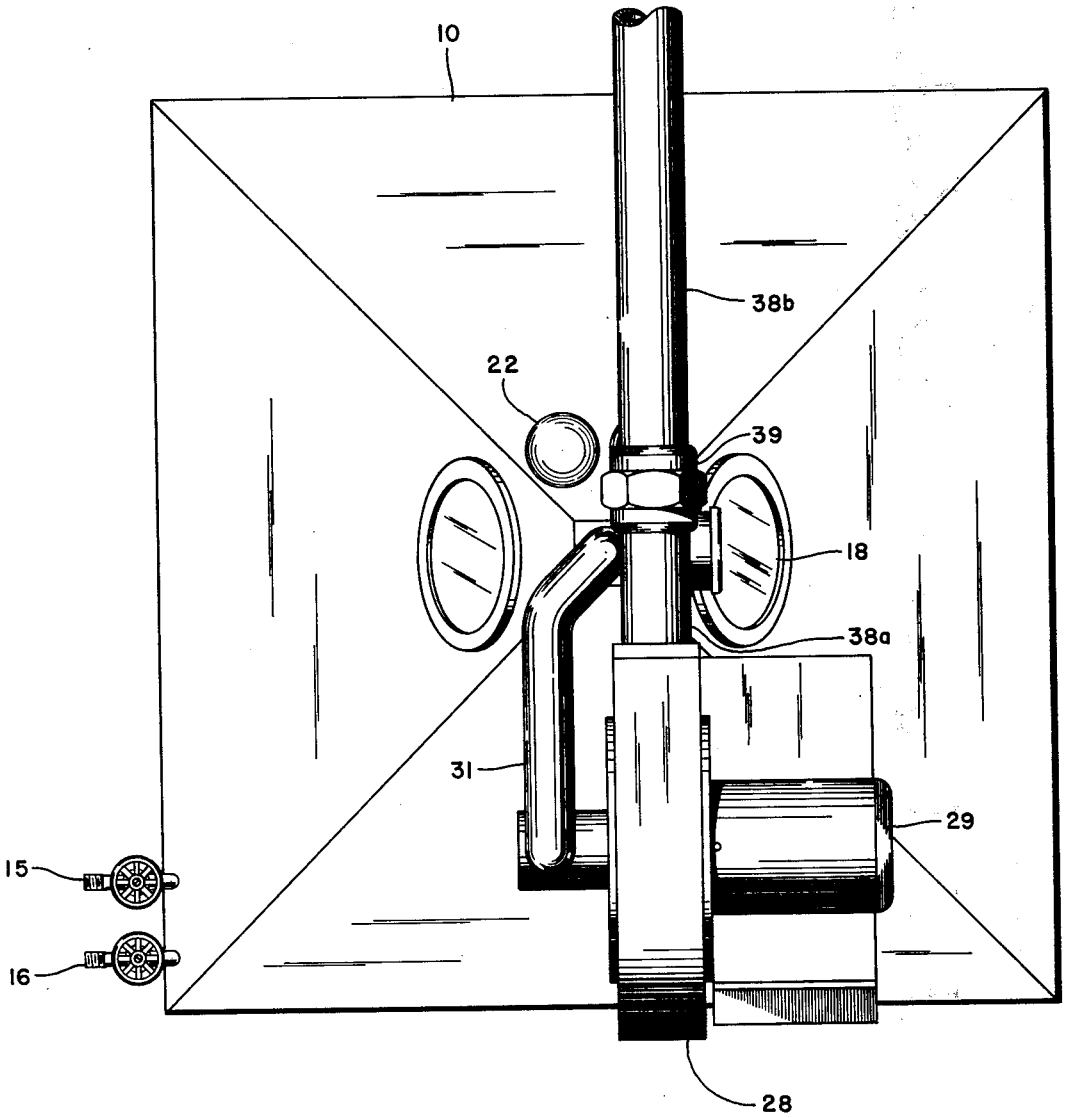
FIG. 3 is a top view of the unit shown in FIG. 1.

Referring to the drawings, a pyramid-shaped container 10 rest on the floor 11, preferably supported by legs as indicated at 12–14. Valves are provided as shown at 15 and 16 for drainage and fill, respectively, of the container 10 with water to the level shown at 17. A window 18 in the wall of the container provides visibility into the interior for the observer to monitor the size and rate of formation of air bubbles emerging from the lower end of the air-inlet conduits 19 and 20. The exterior extremities of these conduits are covered with hoods as shown at 21 and 22, which function in the manner of a chimney cap to prevent the ingress of foreign particles. The conduit 19 is provided with the manually variable throttling valve 23, and the conduit 20 has the similar valve 24. The conduit 20 additionally has the solenoid-operated valve 25, which functions in conjunction with the control of the main blower providing combustion air for the boiler installation generally indicated at 26 in FIG. 1. The blower motor for this installation is shown at 27, and the solenoid valve 25 is interrelated with controls of this motor by appropriate wiring (not shown). Placement of the motor 27 in high-fire operation results in opening the solenoid valve 25 to permit passage of air through the conduit 20.

This movement of air through the conduits 19 and 20 is induced by the auxiliary centrifugal blower 28 driven by the motor 29 secured to the bracket structure 30 mounted on the side of the container 10. The intake of the blower 28 is represented by the pipe 31, which extends from the space in the container 10 above the level of the water shown at 17. Operation of the blower 28 sufficiently reduces the air pressure above the water level 17 to induce air flow in through the conduits 19 and 20, which emerges through the perforations 32–35 in plates 36 welded across the lower ends of the conduits at a substantial incline to the vertical. The holes 32 and 34 are vertically spaced with respect to the holes 33 and 35, as well as the holes 33 and 35 being spaced with respect to each other. As air pressure is progressively reduced from atmospheric, the first hole from which air will emerge will be the top hole 33. Increase in vacuum, or significant reduction of the water level 17, will bring the holes 32 and 34 into function, followed at further decrease in pressure by the emergence of air through the hole 35. The incline of the plate 36 will assist the viewer observing the functioning of the device (through the window 18) in monitoring the size and frequency of the air bubbles emerging from these holes, and will also tend to prevent bubbles emerging from the hole 35 from becoming attached and merging with bubbles emerging through the hole 33. The blower 28 preferably operates at substantially constant speed, and the gage 37 is provided as an indication of the air pressure within the space above the water level 17.

The output of the blower 28 is delivered through the pipe sections **38*a* and 38*b*, interconnected by the coupling 39, to the intake housing 40 associated with the boiler installation 26. Almost the entire quantity of the combustion air for the boiler enters through the grille 41 under the pressure differential established by the blower driven by the motor 27. A minute quantity of air laden with moisture is delivered to the housing 40, where it becomes intermixed with the main bulk of the combustion air entering through the grille 41**.

Since the optimum amount of water vapor to be incorporated in the combustion process of the boiler 26 will be influenced largely by the combustion conditions in the boiler in the absence of added vapor, the initial adjustment of the device shown in the drawings is established by recording the temperature conditions in the boiler very accurately, and then progressively adjusting the valve 23 under low-fire conditions to produce the highest temperature readings. An increase in firing rate requires increased fuel delivery, and a corresponding increase in combustion air. If the motor 27 associated with the boiler combustion unit has a number of intermediate speed conditions, or if the blower delivery rate is increased by opening a valve or shutter (with the motor at substantially constant-speed), a slight increase in the firing rate will bring more of the openings 32–35 of the conduit into action. The number of bubbles emerging from the end of the conduit, as well as the size, is monitored through the window 18, and the flow of air is best considered in terms of the numbers of such bubbles and the resulting effect on the combustion temperature in the boiler 26. Shifting the boiler 26 to high-fire will result in opening the solenoid valve 25, and thus bringing the conduit 20 into action in the same way. The valves 23 and 24 can be separately adjusted to provide the optimum combustion results. It should be kept in mind that the level of the water 17 should be kept fairly close to a standard position, either by periodic manual adjustment of the valves 15 and 16, or by a float-controlled valve (not shown) where it becomes desirable to eliminate supervision of the unit. The quantities of the water used by the device are remarkably small, and would not normally require attention to the water level more frequently than once a month, on the usual installation. The base dimensions of the pyramid can vary between about one foot to three feet on each side, depending on the size of the burner. The shape obviously provides considerable quantity of water within the container for a given surface level at 17. The reason for this arrangement is to provide a considerable water mass to absorb the contamination resulting from small quantities of gases usually present in the furnace room as they become intermixed with the water, and tend to acidify the resulting contents of the container. It is desirable to maintain the concentration of such contaminants at a minimum for the prevention of corrosion. As the concentration approaches an undesirable level, the container can be drained and refilled.

Referring to FIG. 5, a modified form of air intake conduit is shown at 42. The lower section 43 is inclined downwardly, and the end 44 is plugged with a welded closure plate or with a pipe cap. The holes 45 along the upper portion of the section 43 provide air-outlet ports at a graduated depth, so that air delivery can increase in response to small changes in demand (suction).

We claim:

1. A device for supplying minute and controlled quantities of water vapor to a combustion system having blower means adapted to deliver combustion air to a combustion space comprising:

a closed container adapted to be partially filled with water;

an auxiliary blower mounted externally of said container, the suction inlet of said auxiliary blower being connected to the interior of said container above water level therein and the outlet of said auxiliary blower communicating with the inlet of said combustion system blower means;

at least one air inlet tube extending into said container, the upper end of said tube being located externally of said container and above said water level and the lower end of said tube being located within said container and below water level, the lower end of said tube having a plurality of vertically spaced, small diameter air outlet holes;

a manually adjustable valve in each of said air inlet tubes, and;

a pair of windows on opposite side walls of said container located so as to intersect said water level whereby air bubbles within said container may be observed to facilitate adjustment of said valve.

* * * * *